United States Patent [19]

Lanius

[11] Patent Number: 4,838,445

[45] Date of Patent: Jun. 13, 1989

[54] CONTAINER INCLUDING VARIABLE POSITION COMPARTMENT DIVIDERS

[75] Inventor: Charles A. Lanius, Prairie Du Sac, Wis.

[73] Assignee: Flambeau Corporation, Baraboo, Wis.

[21] Appl. No.: 157,282

[22] Filed: Feb. 17, 1988

[51] Int. Cl.[4] ..... A65D 25/06

[52] U.S. Cl. ..... 220/22.3

[58] Field of Search ..... 220/22, 22.1, 22.2, 220/22.3

[56] References Cited

U.S. PATENT DOCUMENTS

| | | | |
|---|---|---|---|
| 417,640 | 12/1889 | Hirsch | 220/22.3 |
| 710,092 | 9/1902 | Brand . | |
| 1,561,351 | 11/1925 | Nielsen . | |
| 1,666,172 | 4/1928 | Gollnick . | |
| 2,169,318 | 8/1939 | Copeland | 220/22.3 |
| 2,681,201 | 6/1954 | Grunwald . | |
| 2,718,326 | 9/1955 | Le Blanc . | |
| 3,391,816 | 7/1968 | Swett | 220/22 |
| 3,554,429 | 1/1971 | Cohen . | |
| 3,612,337 | 10/1971 | Harger | 220/22.3 |
| 4,130,153 | 12/1978 | Zopf | 220/22 |
| 4,261,465 | 4/1981 | Thomas | 220/22.3 |
| 4,602,715 | 7/1986 | Sarver et al. . | |
| 4,705,168 | 11/1987 | Ward | 220/22.2 |

FOREIGN PATENT DOCUMENTS

| | | | |
|---|---|---|---|
| 926323 | 4/1955 | Fed. Rep. of Germany | 220/22.2 |

*Primary Examiner*—George F. Lowrance

*Attorney, Agent, or Firm*—Michael, Best & Friedrich

[57] ABSTRACT

A container such as a tackle box including a plurality of spaced apart partitions defining a plurality of cavities, the faces of the partitions having a plurality of uniformly spaced, generally parallel ribs perpendicular to the container bottom, and divider members extending between the partitions and dividing the cavities, the opposite ends of the divider members having projecting flanges extending in generally opposite directions and having faces adapted to engage the surfaces of the partitions, and the faces having a plurality of uniformly spaced, generally parallel ribs adapted to engage and nest between ribs of the partitions the flanges are each resiliently flexible and each is resiliently biased into engagement with the partitions.

3 Claims, 1 Drawing Sheet

CONTAINER INCLUDING VARIABLE POSITION COMPARTMENT DIVIDERS

BACKGROUND OF THE INVENTION

The invention relates to containers, and more particularly to containers such as sport tackle boxes having variable position compartment dividers.

In the manufacture of sport tackle boxes and other similar containers there is a need for the container to be divided by partitions which subdivide the container into compartments having a size suitable for the articles to be placed into the compartments.

Examples of prior art containers or tackle boxes are illustrated in the U.S. Sarver Pat. No. 4,602,715, issued July 29, 1986; the U.S. Cohen Pat. No. 3,554,429, issued Jan. 12, 1971; the U.S. LeBlanc Pat. No. 2,718,326, issued Sept. 20, 1955; the U.S. Grunwald Pat. No. 2,681,201, issued June 15, 1954; the U.S. Gollnick Pat. No. 1,666,172, issued Apr. 17, 1928; the U.S. Nielson Pat. No. 1,561,351, issued Nov. 10, 1925; and the U.S. Brand Pat. No. 710,093, issued Sept. 39, 1902.

SUMMARY OF THE INVENTION

The invention provides a container of the type used as a tackle box or the like and including at least a pair of spaced apart generally parallel partitions defining a cavity, and a divider member extending between the pair of partitions and dividing the cavity into a first cavity portion and a second cavity portion. The divider member has opposite ends each including at least one flange portion having a face in opposed relation to one of the partitions, and the flange face having means for engaging the partition. The surfaces of the partitions engaged by the flanges of the divider member each include a plurality of parallel closely spaced ribs and grooves, and the faces of the flanges also each include a plurality of closely spaced parallel ribs adapted to cooperate with the opposed ribs of the partitions to prevent slideable movement of the dividers in the direction of the longitudinal axis of the partitions. The dividers can be positioned between the partitions at any one of a large number of positions by slideably inserting the divider member in the direction perpendicular to the bottom or floor of the container.

In one embodiment, the opposite ends of the divider member each include a pair of flanges extending in opposite directions, each of the flanges having a face in opposed facing relation to one of the partitions.

In one embodiment the flanges of the divider member are resiliently flexible and each flange is resiliently biased into engagement with the partitions.

It is an object of the invention to provide a compartmentalized container or tackle box with means for subdividing the compartments of the container or tackle box into spaces of various sizes such that the spaces are well suited to hold articles of differing sizes. One of the features or advantages of the construction embodying this invention is that the divider members engage the partitions such that the dividers will not slide out of position in a direction parallel to the length of the partitions. The plurality of ribs on the opposed faces of the partitions and the flanges cooperate as the divider is inserted between the partitions. The cooperation of the ribs prevents the divider member from sliding in a direction perpendicular to the ribs. Additionally, the plurality of ribs provides the advantage of inserting the divider member into innumerable positions such that the compartment may be subdivided into compartments of various sizes.

Various other features and advantages of the invention will become apparent to those skilled in the art upon review of the following detailed description, claims and drawings.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 1:
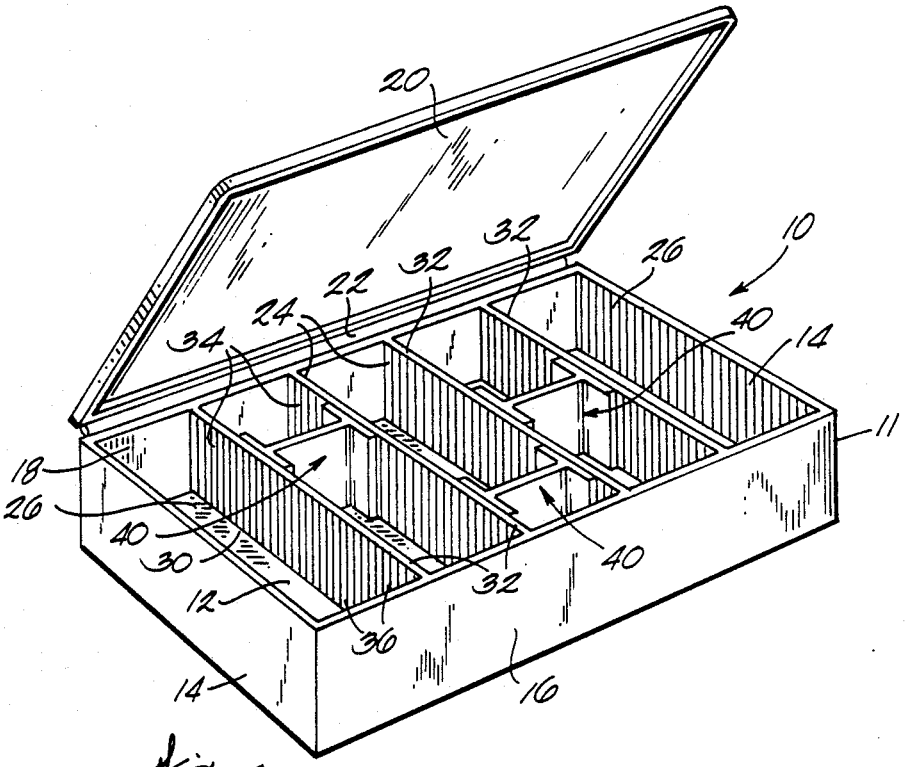
FIG. 1 is a perspective view of a compartmentalized container embodying the invention.

Shown in FIG. 1 is a compartmentalized container or tackle box 10 including a base 11 having a bottom 12, opposite end walls 14 and opposed side walls 16 and 18. While it will be readily understood that the container 10 could have alternative constructions, in the illustrated arrangement, the container 10 also includes a cover 20 attached to the base 11 by a flexible hinge 22. The container 10 further includes partitions 24 extending between the side walls 16 and 18 and dividing the volume of the base 11 into a plurality of generally parallel compartments 26 of uniform width. While the base 11 is illustrated as having four partitions, it will also be appreciated that the base 11 could include more or fewer partitions 24 and the partitions 24 could be supported in other ways and in other arrangements. In the illustrated embodiment, the partitions 24 include opposite ends joined to the side walls 16 and 18. The partitions 24 are also illustrated as having a lower edge 30 joined to the bottom 12 and a linear upper edge 32. The partitions 24 also each have opposite generally planar faces 34, the opposite faces 34 each including a plurality of closely spaced parallel ribs 36 (FIG. 3) extending from the faces 34 of the partitions 24. The ribs 36 are linear and extend generally perpendicular to the surface defined by the bottom 12 of the tackle box and extend from the lower edge 30 of the partition to the upper edge 32 of the partition. The parallel ribs define a plurality of closely spaced complementary parallel linear grooves.

Figure 2:
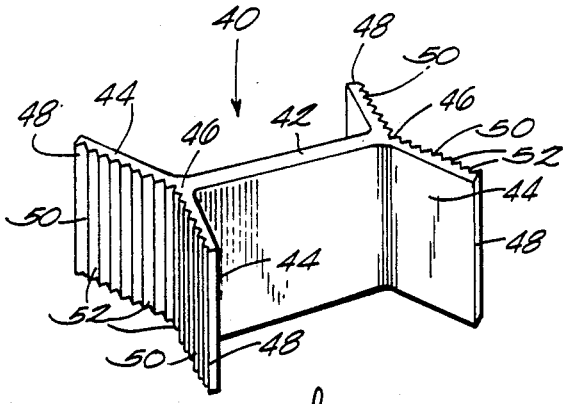
FIG. 2 is a perspective view of a divider member apart from the compartmentalized container.

The container 10 also includes at least one divider member 40 which subdivides a compartment 26 into two smaller compartments. In the preferred embodiment, the divider member 40 includes a planar web 42 having opposite ends. The opposite ends of the web 42 each support a pair of flexible flanges or flange members 44. The flange members 44 each have a portion 46 integrally joined to the web 42 of the divider member. Each flange 44 also has a free edge 48 which extends away from the web 42 of the divider member and in a direction generally away from the flange member with which it is paired. In one form of the invention the divider members 40 are comprised of a material such as nylon, polypropylene or other material which is flexible but which will provide a rigid divider when inserted between the partitions. As shown in FIG. 2 when the divider members are removed from the container 10, each flange member 44 is generally planar and defines an angle greater than ninety degrees (90°) with respect to the adjacent face of the web 42. The included angle defined by two faces 50 of the flanges 44 is an obtuse angle less than 180°. The faces 50 of the flanges 44 each include a plurality of closely spaced linear parallel ribs 52 complementary to the ribs 36 of the partitions.

Figure 3:
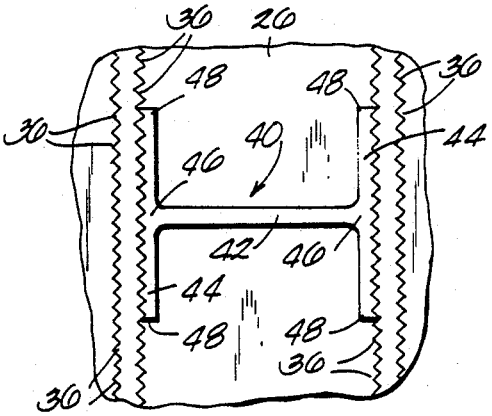
FIG. 3 is an expanded partial plan view of a divider member in position between the sides of a compartment in the compartmentalized container.

When as shown in FIG. 3, the divider member 40 is inserted between a pair of partitions, the resilient flanges 44 are compressed so as to be substantially planar such that the divider can be slideably positioned between the positions. Because the flanges 44 are resilient and tend to flex toward the position shown in FIG. 2, when the divider member 40 is positioned between the partitions as shown in FIG. 3, the flanges 44 resiliently engage the faces of the partitions and the ribs 50 of the flanges will engage the implementary ribs 36 of the partitions to prevent movement of the divider member 40 in the direction between the sides 16 and 18.

Various features of the invention are set forth in the following claims.

I claim:

1. A compartmental container comprising a molded plastic container including a bottom and sides, said molded plastic container also including a plurality of spaced apart partitions molded integrally with said container, said integral partitions extending between the sides and defining a plurality of compartments, each of said partitions having opposite faces, at least one of the faces including a plurality of uniformly spaced, generally linear and parallel ribs extending in a direction generally perpendicular to said bottom of said container, and a plastic divider member extending between a pair of said partitions and dividing the compartment into a first compartment portion and a second compartment portion, the divider having opposite ends, one of the opposite ends having a first end flange and a second end flange, said first and second end flanges having an edge integrally joined with said first opposite end, said first end flange and said second end flange extending in generally opposed directions, said first end flange having a first face and said second end flange having a second face, said first face and said second face being in opposed facing relation to one of said faces of said partitions and having a plurality of uniformly spaced, generally linear and parallel ribs adapted to engage the ribs of said one of said faces of said one of said partitions, the other opposite end having a third end flange and a fourth end flange, said third and fourth end flanges having an edge integrally joined with said other opposite end and extending in generally opposed directions, said third end flange having a third face and said fourth end flange having a fourth face, said third face and said fourth face in opposed facing relation to one of said partitions and each having a plurality of uniformly spaced generally linear and parallel ribs adapted to engage the ribs on the face of the other of said partitions, said first and second and third and fourth end flanges each being resiliently flexible and resiliently biased into engagement with said partitions, said divider member being slidable between a retracted position wherein said divider is removed from between said pair of partitions and an inserted position wherein said divider is positioned between said pair of partitions and wherein said ribs prevent slidable movement of said divider in the longitudinal direction of said parallel partitions, and said divider member having a resiliently flexible central wall portion extending between said opposite ends.

2. A compartmental container in accordance with claim 1 wherein said container and said divider member is fabricated of polypropylene.

3. A compartmental container in accordance with claim 1 wherein said central wall portion has a linear upper edge.

* * * * *